US009347404B2

(12) United States Patent
Menke

(10) Patent No.: US 9,347,404 B2
(45) Date of Patent: May 24, 2016

(54) FILTER ARRANGEMENT FOR A TANK VENTILATION SYSTEM OF A FUEL TANK

(71) Applicant: Dr. Ing. h.c. F. Porsche Aktiengesellschaft, Stuttgart (DE)

(72) Inventor: Andreas Menke, Vaihingen a.d.Enz/Enzweihingen (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 276 days.

(21) Appl. No.: 14/058,576

(22) Filed: Oct. 21, 2013

(65) Prior Publication Data

US 2014/0109879 A1 Apr. 24, 2014

(30) Foreign Application Priority Data

Oct. 22, 2012 (DE) ..... 10 2012 110 063

(51) Int. Cl.
*F02M 33/02* (2006.01)
*F02M 25/08* (2006.01)

(52) U.S. Cl.
CPC ..... *F02M 25/0854* (2013.01); *F02M 25/08* (2013.01)

(58) Field of Classification Search
CPC ..... F02M 25/0854; F02M 25/0836; F02M 25/0818; F02M 25/0827; B01D 2259/4516; B01D 2253/102; G01M 3/3263
USPC ..... 123/516–520; 137/583–589
See application file for complete search history.

(56) References Cited

U.S. PATENT DOCUMENTS

| | | | | |
|---|---|---|---|---|
| 5,460,136 | A * | 10/1995 | Yamazaki | F02M 25/0854 123/519 |
| 6,540,815 | B1 | 4/2003 | Hiltzik et al. | |
| 7,008,470 | B2 * | 3/2006 | Makino | B01D 53/02 123/519 |
| 7,047,952 | B1 * | 5/2006 | Yamauchi | B01D 53/0415 123/519 |
| 7,305,974 | B2 * | 12/2007 | Nakano | B01D 53/02 123/516 |
| 7,841,321 | B2 * | 11/2010 | Kosugi | F02M 25/0854 123/519 |
| 8,596,250 | B2 * | 12/2013 | Sugiura | F02M 25/0854 123/519 |
| 2009/0013973 | A1 * | 1/2009 | Yamasaki | F02M 25/0854 123/519 |
| 2015/0114362 | A1 * | 4/2015 | Costa-Patry | F02D 17/04 123/521 |

* cited by examiner

*Primary Examiner* — Hai Huynh
*Assistant Examiner* — Gonzalo Laguarda
(74) *Attorney, Agent, or Firm* — Gerald Hespos; Michael Porco; Matthew Hespos

(57) ABSTRACT

A tank ventilation system of a fuel tank (2) has at least one housing (20) with a tank-side fuel vapor inlet opening (22), an engine-side fuel vapor outlet opening (26) and an atmosphere opening (24). The housing (20) has at least one first adsorption region (32) and a second adsorption region (34) upstream of the fuel vapor outlet opening (26). The second adsorption region (32) has a substantially lower absorption capacity than the first adsorption region (32), which is placed in a direction of flow toward the atmosphere opening (24).

13 Claims, 1 Drawing Sheet

FILTER ARRANGEMENT FOR A TANK VENTILATION SYSTEM OF A FUEL TANK

CROSS REFERENCE TO RELATED APPLICATION

This application claims priority under 35 USC 119 to German Patent Appl. No. 10 2012 110 063.2 filed on Oct. 22, 2012, the entire disclosure of which is incorporated herein by reference.

BACKGROUND

1. Field of the Invention

The invention relates to a filter arrangement for a tank ventilation system of a fuel tank. The filter arrangement has a housing with a tank-side fuel vapor inlet opening, an engine-side fuel vapor outlet opening, an atmosphere opening and has at least one first adsorption region.

2. Description of the Related Art

Filter arrangements for a tank ventilation system are well known in the motor vehicle industry and are used to reduce evaporative emissions. Emissions of this type can arise, for example, by fuel vapor being produced by high temperature changes over the course of a day. It is also possible that, after a journey at high speed, the heat of the engine is conducted to the fuel tank and produces the fuel vapor. Of course, fuel vapor also arises during refueling. To prevent the fuel vapor from being output to the atmosphere, the fuel vapor is fed via a tank-side fuel vapor inlet opening to the filter arrangement and, on the way to the atmosphere opening, flows through a housing that is filled with adsorbents that adsorb the hydrocarbon molecules in the fuel vapor. Accordingly, cleaned air can leave the filter arrangement via the atmosphere opening.

The filter arrangement is cleaned and/or emptied by opening an engine-side fuel vapor outlet opening via a valve arrangement in the fuel-operated driving mode. A negative pressure prevails at the opening and ensures that ambient air is fed via the atmosphere opening to the filter arrangement and, during the passage through the adsorption region, detaches the accumulated hydrocarbon molecules again and feeds the molecules to the combustion air for subsequent combustion.

A multiplicity of documents are concerned with optimizing the adsorption of fuel vapor, and an excessive pressure differential from the fuel vapor inlet opening to the atmosphere opening has been perceived to be the main problem. To improve the adsorption operation, it is known, for example, from U.S. Pat. No. 6,540,815 B1, to provide various adsorption regions in the housing of a filter arrangement. The adsorption capacity decreases ever further, as seen in the direction of flow, from the fuel vapor inlet opening toward the atmosphere opening. More particularly, at the fuel vapor inlet opening or fuel vapor outlet opening there is an adsorption region that has a very high absorption capacity and, at the atmosphere opening, there is an absorption region having a very small absorption capacity.

A filter arrangement designed in such a manner delivers good results for the absorption of gaseous hydrocarbon molecules. However, such a filter arrangement has become problematic against the background of developing highly modern combustions engines or hybrid engines, optimally to control the purging operation of the filter arrangement. For example, in the case of hybrid engines, the operating times for a purging operation are extremely limited because of the switching off of the internal combustion engine. Furthermore, all types of engines are activated evermore precisely in respect of the fuel/air mixture, which results in a large outlay in terms of control technology for the purging operation to avoid too lean or too rich a fuel mixture.

It is therefore the object of the invention to provide a filter arrangement that assists and ensures the regulation of the internal combustion engine during the purging operation of the filter arrangement in a simple and cost-effective manner.

SUMMARY OF THE INVENTION

The invention relates to a filter arrangement with a second adsorption region and a second adsorption region. The second adsorption region is provided at least upstream of the fuel vapor outlet opening. The second adsorption region has a substantially lower absorption capacity than the first adsorption region, which is placed in the direction of flow toward the atmosphere opening. Thus, a very gentle rise in concentration of hydrocarbon molecules in the fuel vapor present at the engine-side fuel vapor outlet opening should be recorded during the purging operation. As a result, the regulation of the internal combustion engine during the purging operation at very short purging intervals is facilitated. In an advantageous manner, the second adsorption region takes up 5%-15%, preferably 10%, of the entire volume of the housing.

In contrast to U.S. Pat. No. 6,540,815 B1, the filter arrangement of the invention has an adsorption region that has a very small absorption capacity at the fuel vapor outlet opening and an adsorption region at the atmosphere opening with a very high absorption capacity.

The second adsorption region preferably also is provided upstream of the fuel vapor inlet opening, and the volume/area ratio assigned to the fuel vapor outlet opening preferably is greater than the volume/area ratio assigned to the fuel vapor inlet opening. It has proven advantageous if the volume/area ratio assigned to the fuel vapor outlet opening is approximately twice the size of the volume/area ratio assigned to the fuel vapor inlet opening. It was possible to establish that, during the purging operation, only the region close to the fuel vapor outlet opening is purged thoroughly actively by the air and regions remote from the fuel vapor outlet opening participate in the desorption only by fusion. Therefore, the area of the second adsorption region that participates in the active purging is substantially increased.

In a first embodiment, activated carbon is used as the adsorbent for all of the adsorption regions. However, the adsorbent of the second adsorption region has a substantially smaller specific working capacity than the adsorbent of the first adsorption region. Alternatively, a different adsorbent, such as refuse coal, is used as the adsorbent of the second adsorption region, whereas all of the further adsorption regions provide activated carbon as the adsorbent.

The invention is explained in more detail with reference to the drawing.

DETAILED DESCRIPTION OF THE PREFERRED EMBODIMENTS

Figure 1:
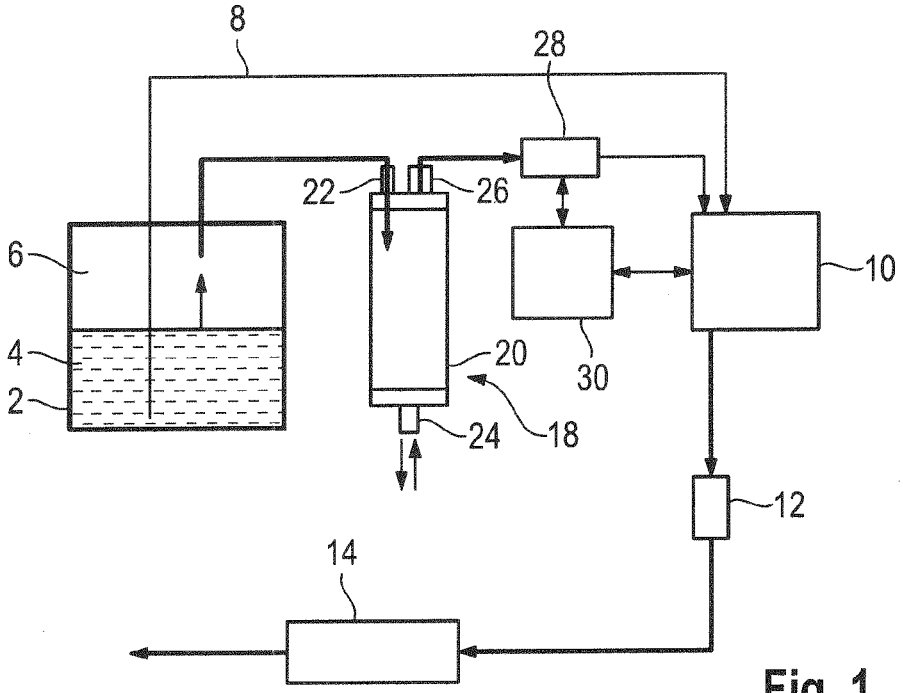
FIG. 1 is a schematic view of an internal combustion engine with a tank ventilation system.

FIG. 1 shows a fuel tank 2 that is filled partially with hydrocarbon-containing fuel 4. The tank volume located above the fuel volume is taken up by highly volatile hydrocarbons and therefore constitutes a hydrocarbon-containing gas 6. The fuel 4 is conveyed in a known manner via a supply line 8 from the fuel tank 2 to an internal combustion engine 10. An exhaust gas produced by the internal combustion engine 10 is output to the surroundings via a catalytic converter 12 and a muffler 14.

A filter arrangement 18 is provided so that the low-boiling hydrocarbons cannot pass as fuel vapor into the atmosphere via a tank ventilation system. The filter arrangement 18 has a housing 20 that is connected to the fuel tank 2 via a tank-side fuel vapour inlet opening 22. Furthermore, the housing 20 has an atmosphere opening 24 and an engine-side fuel vapor outlet opening 26. The fuel vapor outlet opening 26 is connected in a known manner via a regeneration valve 28 to the internal combustion engine 10 so that, during the "purging operation", fuel vapor can be fed to the combustion process of the internal combustion engine 10. Furthermore, an engine controller 30 is provided in a known manner to regulate the purging operation and to optimize the combustion process.

Figure 2:
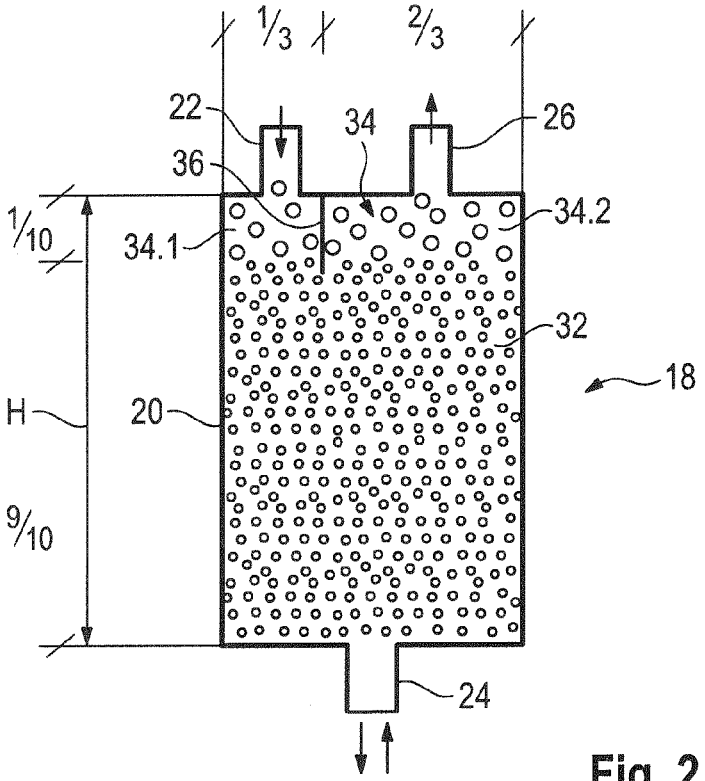
FIG. 2 is a schematic sectional view of a filter arrangement according to the invention.

The filter arrangement 18 has first and second adsorption regions 32, 34, as shown in FIG. 2. The first adsorption region 32 is adjoined, as seen in the direction of flow toward the fuel vapor outlet opening 26, by a second adsorption region 34. The second adsorption region 30 has a substantially smaller absorption capacity than the first adsorption region 32. To ensure a simple construction of the filter arrangement 18, in the present embodiment the second adsorption region 34 is upstream of the fuel vapor inlet opening 22.

In the illustrated embodiment, the second adsorption region 34 takes up approximately 10% of the entire volume of the housing 20 of the filter arrangement 18. Furthermore, in the illustrated embodiment, activated carbon is the adsorbent both for the first adsorption region 32 and for the second adsorption region 34. It should be clear, however, that other fillers can be selected as the adsorbent. In particular, it is conceivable, for the second adsorption region, to select refuse coal which, in addition to the smaller absorption capacity, advantageously acts in a damping manner on the purging flow, and therefore results in a smaller rise in concentration of hydrocarbon molecules at the fuel vapor outlet opening 26. Of course, it is also conceivable for further adsorption regions to be provided in the direction of the atmosphere opening 24, as also depicted in U.S. Pat. No. 6,540,815 B1. The height of the filter arrangement 18 is denoted by H, and, in the illustrated embodiment, the first adsorption region 32 takes up 9/10, and the second adsorption region 34 takes up 1/10, of the region of the filter arrangement 18 that is filled with activated carbon.

Reference numbers 34.1 and 34.2 indicate that the volume/area ratio 34.2 assigned to the fuel vapor outlet opening is approximately twice the size of the volume/area ratio 34.1 assigned to the fuel vapor inlet opening 22. In the present exemplary embodiment, the different volume/area ratios 34.1 and 34.2 are ensured by a separating element 36. This ensures that a substantially larger region of the second adsorption region 34 participates in the active flow through during the purging operation. The buffer effect becomes greater as the separating element 36 penetrates deeper into the second adsorption region 34, i.e. the longer the separating element is. The hydrocarbon molecules from the second adsorption region 34 initially are desorbed during the purging operation and results in a very moderate rise in the concentration of the fuel vapor. The quantity of hydrocarbon molecules fed to the internal combustion engine 10 rises only at a later point of the purging operation when the hydrocarbon molecules are desorbed from the remaining adsorption region 32, or from the remaining adsorption regions, if further adsorption regions are present. A reduced supply of hydrocarbon molecules is thereby temporarily possible in a simple and cost-effective manner, especially during short purging operations.

What is claimed is:

1. A filter arrangement for a tank ventilation system of a fuel tank, comprising at least one housing with opposite first and second ends, at least a tank-side fuel vapor inlet opening and an engine-side fuel vapor outlet opening in proximity to the second end of the housing and an atmosphere opening in proximity to the first end of the housing, the filter arrangement having at least one first adsorption region in proximity to the first end of the housing and at least a second adsorption region in proximity to the second end of the housing and upstream of the fuel vapor outlet opening, said second adsorption region taking up between 5% and 15% of an entire volume of the housing and having a substantially lower absorption capacity than the first adsorption region which is placed in a direction of flow toward the atmosphere opening.

2. The filter arrangement of claim 1, wherein the second adsorption region also is upstream of the fuel vapor inlet opening, wherein the volume/area ratio assigned to the fuel vapor outlet opening is greater than the volume/area ratio assigned to the fuel vapor inlet opening.

3. The filter arrangement of claim 2, wherein the volume/area ratio assigned to the fuel vapor outlet opening is approximately twice the volume/area ratio assigned to the fuel vapor inlet opening.

4. The filter arrangement of claim 1, wherein activated carbon is the adsorbent for all of the adsorption regions.

5. The filter arrangement of claim 1, wherein the adsorbent of the first adsorption region is activated carbon and the adsorbent of the second adsorption region is an adsorbent other than activated carbon.

6. The filter arrangement of claim 5, wherein the adsorbent of the second adsorption region is refuse coal.

7. A tank ventilation system for use with a fuel tank and an internal combustion engine, comprising: a housing with opposite first and second ends; an atmosphere opening in proximity to the first end of the housing and communicating with atmosphere surrounding the tank ventilation system; a fuel vapor inlet opening in proximity to the second end of the housing and communicating with the fuel tank; a fuel vapor outlet opening in proximity to the second end of the housing and communicating with the internal combustion engine; a first adsorption region defined in proximity to the first end of the housing and having a first adsorbent therein; and a second adsorption region defined in proximity to the second end of the housing between the first adsorption region and the fuel vapor outlet opening and having a second adsorbent therein, the second adsorption region taking up between 5% and 15% of an entire volume of the housing and having a substantially lower absorption capacity than the first adsorption region.

8. The tank ventilation system of claim 7, further comprising a separating element projecting into the second adsorption region between the fuel vapor inlet opening and the fuel vapor outlet opening, the separating element being disposed so that a volume/area ratio of the second adsorption region assigned to the fuel vapor outlet opening is greater than a volume/area ratio of the second adsorption region assigned to the fuel vapor inlet opening.

9. The tank ventilation system of claim 8, wherein the volume/area ratio assigned to the fuel vapor outlet opening is approximately twice the volume/area ratio assigned to the fuel vapor inlet opening.

10. The tank ventilation system of claim 7, wherein the first adsorption region is between the second adsorption region and the atmosphere opening.

11. The tank ventilation system of claim 7, wherein activated carbon is the adsorbent for the first and second adsorption regions.

12. The tank ventilation system of claim 7, wherein the adsorbent of the first adsorption region is activated carbon and the adsorbent of the second adsorption region is an adsorbent other than activated carbon.

13. The tank ventilation system of claim 7, further comprising a regeneration valve between the fuel vapor outlet opening and the internal combustion engine and an engine controller communicating with the regeneration valve and the internal combustion engine for controlling purging of the adsorbents in the housing.

* * * * *